United States Patent [19]

Goddard

[11] 3,946,273

[45] Mar. 23, 1976

[54] SPLIT CROSS FADER FOR THE CONTROL OF THEATRE LIGHTING

[76] Inventor: Robert M. Goddard, 55 First Ave., New York, N.Y. 10803

[22] Filed: Aug. 19, 1974

[21] Appl. No.: 498,460

[52] U.S. Cl. ..... 315/297; 315/315; 315/318; 315/320

[51] Int. Cl.[2] ..... H05B 37/02

[58] Field of Search ..... 315/292, 297, 315, 316, 315/318, 320

[56] References Cited

UNITED STATES PATENTS

| | | | |
|---|---|---|---|
| 3,534,224 | 10/1970 | Skirpan et al. | 315/292 X |
| 3,706,913 | 12/1972 | Malatchi | 315/292 |
| 3,706,914 | 12/1972 | VanBuren | 315/292 X |

*Primary Examiner*—Palmer C. Demeo
*Attorney, Agent, or Firm*—Kenyon & Kenyon Reilly Carr & Chapin

[57] ABSTRACT

A split cross fader for the control of theatre lighting in which functions previously found only in separate master control units and cross fader units are combined into a single device which permits operation as a scene master, as a cross fader and also permits pile-on operation with smooth fading between each scene condition commanded.

24 Claims, 10 Drawing Figures

SPLIT CROSS FADER FOR THE CONTROL OF THEATRE LIGHTING

BACKGROUND OF THE INVENTION

This invention relates to theatre lighting in general and more particularly to an improved split cross fader control for use in controlling such lighting.

The advantages of voltage control of various types of devices is well recognized in the art. Through remote control by low voltage and low current signals, miniaturized controllers and sophisticated pre-processing of inputs is possible. Furthermore, the storage of any number of pre-program commands is possible. The usefulness of such control has been recognized in the theatre lighting art. Voltage controlled dimmers have been used with increasing regularity over the past 40 years. In particular, since the development of the thyristor in the late part of the 1950's, large scale usage of voltage controlled theatre lighting has become a reality. Through such voltage control, miniature control consoles or desks can be built to control up to several hundred dimmers. Typically in such consoles, dimmers are controlled by miniature potentiometers. It is evident that in order to accurately perform changes of more than a few dimmers would require the coordination of a large number of actions and becomes physically impossible. As a result, various forms of mastering, subgrouping and presetting have been devised for use in theatre lighting control.

Various types of systems are disclosed in a booklet entitled "Professional Lighting Control", published by Skirpan Electronics, 1968. This booklet discloses typical equipment available for theatre lighting control. In addition, the same company has developed a computerized system sold under the trademark "Autocue".

In a typical installation each lighting circuit to be controlled has associated therewith a dimmer control which is responsive to an analog input voltage to control the light to a level proportional thereto. Such dimmers are available from various manufacturers. In particular, they are available from the above-mentioned Skirpan Electronics. The desired lighting over the period of a program is predetermined and divided into what are referred to as cues or scenes. The conventional practice is to provide a plurality of potentiometers, one being provided for each circuit used in a cue or scene with the potentiometers being preset to provide the required analog voltage output to the respective dimmers. In some cases, the potentiometers are coupled to the dimmers through a patch panel to permit greater system flexibility. Also, in some systems the outputs of the individual dimmers are coupled to the lamps which they control through a further power patch panel to add further flexibility. These potentiometers in general terms comprise a memory system which records the desired levels for each cue or scene. In its simplest form, the memory in the prior art consisted of multiple potentiometers for each dimmer. One potentiometer per dimmer per scene is required. Thus, in a 12 dimmer, two preset console, 24 potentiometers would be required, i.e. 12 potentiometers for each scene. In an installation with 300 dimmers and having ten present scenes, the console would require 3000 potentiometers. In addition to this type of installation, other storage systems have been used including various forms of electrical and electromechanical memories. Such have been used with varying degrees of success.

Most commonly in use today are potentiometers although in very large systems various types of electronic memories have been used such as in the above-mentioned computerized system where the cues are stored in the memory of a digital computer and converted to analog output voltages by means of digital to analog converters.

Presetting alone, however, will not provide as esthetically pleasing control of the theatre lighting. It is further necessary to be able to shift from one cue to the next in an orderly, smooth fade. Such is required because stage lighting can rarely be satisfactorily accomplished if all that is available are snap cues where the levels change instantaneously from one level to another. Basically, two approaches to this problem have been taken. One approach is through the use of what is referred to as a scene master. As noted above, cues in storage are usually referred to as scenes. The other approach is through the use of what is referred to as a cross fader. In the scene master approach, a master control is provided for each group of preset potentiometers or other storage devices. In some cases, subscene masters for controlling subgroups of dimmers which may be faded in and out of a scene separately are used. In this type of arrangement, the preset potentiometers or other memory devices obtain their inputs from the master control and provide an output, normally a DC voltage, having a magnitude proportional to the setting of the storage element multiplied by the setting of the scene master. In the art, the scene master setting is normally defined in terms of a decimal less than or equal to one or as a percentage. The value of the storage element is usually expressed as a number less than or equal to 100 or less than or equal to 10. For example, with a master set at 0.5 and a storage element or potentiometer set at 8 an output of 4 would result.

Thus, for each scene to be provided a scene master is installed having its output coupled to a set of preset potentiometers or the like. As noted above, the output of these preset devices is used as the dimmer control input. The outputs of the preset potentiometers for each scene are combined channel by channel and coupled to the dimmer in such a manner that the scene with the highest output will determine the output level of that channel or dimmer. Through this arrangement, an additional new scene can be constructed by bringing up more than one scene master at one time. An example of the manner in which this work is given in table I below. The rows labeled scene 1 and scene 2 give the values of the memory elements in the two scenes, each five dimmers. The row labeled pile-on scene is the new resulting scene which occurs when both scene 1 and scene 2 are brought up to a full at once. The last line in the table referring to a cross fader will be described below.

TABLE I

| | dimmers | | | | |
|---|---|---|---|---|---|
| | 1 | 2 | 3 | 4 | 5 |
| Scene I | 0 | 5 | 10 | 7 | 8 |
| Scene II | 9 | 4 | 0 | 7 | 10 |
| Pile On Scene | 9 | 5 | 10 | 7 | 10 |
| Crossfader at ½ | 4.5 | 4.5 | 5 | 7 | 9 |

Despite the advantages available in creating a pile-on scene, there are certain disadvantages in this approach. One of the primary disadvantages is that the fades of many dimmers will be non-linear during pile-on. This results because the output only reflects the highest level coming from the presets. For example, if scene 1 were at full and scene 2 were faded from zero to full, dimmer 1 would fade smoothly from zero to nine. However, dimmer 5 would remain at 8 until the output of scene 2 on channel 5 was greater than 8. Thus, this would occur only when the master reached a value of greater than 0.8 thereby causing dimmer 5 to fade up only in the last 20% of the master travel. A further disadvantage occurs where it is desired to fade one scene smoothly into the other. In such a case, one of the scenes, for example scene 2 have its master set at zero. The operator then lowers one master while raising the other. Ideally, what is desired is for the dimmers to slowly shift from the setting of one scene to that of the other. In the example of table 1 this will happen with the dimmers 1 and 3 but not in the other channels. Channel 4, which has the same value for both presets, would be expected to stay at that same value throughout the fade. Instead, if the masters are faded in such a way that both of them reach 0.5 at the same time the output of channel 4 will drop to 3.5 and then fade back up to 7. This problem is referred to as "fader dip". Thus, the scene master arrangement cannot provide smooth fading from one scene to the other in all instances.

The use of the cross fader is an attempt to overcome this problem. The cross fader is a single control which acts as a two sided master. By moving a control handle from one end of its travel to the other, one scene is faded in while the other is simultaneously faded out. For a two scene console the scenes are permanently assigned. In multiple scene units switching or patching is provided to enable each of the present scenes to be assigned to either end of the fader at will. In conventional terminology, the ends of the cross fader are referred to as the X and Y sides. A dipless cross fader must satisfy the following equation:

$$C_{1X} \cdot P_X + C_{1Y} \cdot P_Y = O_1 \text{ and } P_Y + P_X = 1$$

where:

$C_{1X}$ is the Channel One X scene value
$C_{1Y}$ is the Channel One Y scene value
$P_X$ is the value of the preset X-side of fader
$P_Y$ is the value of the preset Y-side of fader
$O_1$ is the output to the dimmer.

The last line of Table I above shows what the cross fader outputs would be for the two listed scenes. Thus, at one half the cross fader will in channel 1 be at 4.5, halfway between zero and nine. Similarly, in channel 3 it will be at 5 halfway between zero and 10. Likewise channels 2 and 5 will be halfway between the two cues. Channel 4, which remains at 7 for both scenes, will be at 7 with the cross fader at half. Cross faders work quite well but have limited flexibility. This lack of flexibility causes problems in simple consoles with limted storage capacity. Specifically they do not have the capability of the scene master type of control where pile-on scenes can be created.

Thus, it is clear that the combination of the advantages of the scene master operation and cross fader operation would provide many useful benefits. Such has been attempted combining two scene masters next to each other and calling it a cross fader. However, such an arrangement does not cure the problem of dip referred to above. On the other hand, if a standard cross fader is built with two separate handles, it will operate properly for cross fades as long as it follows the equation given above. However, since both sides of the cross fader can be separately operated and can both be full at once, the second equation which must be satisfied, i.e. $P_X + P_Y = 1$ will no longer be true if both are at full. In such a case $P_Y + P_X = 2$. In such a case, if the scene 1 preset pot is at 5 and the scene 2 pot is at 6, then the pile-on of the two would be 11, much higher than either scene and in fact higher than the defined maximum value of 10. One attempt at solving this problem would be defining a split cross fader such that it followed the logic of a normal cross fader except that the output would be limited for each channel so that it would never exceed the higher of the two presets in use. Such a design would satisfy the end point condition for pile-on and would not dip during cross fades. However, pile-on fades of channels having non-zero values in both the X and Y presets would be non-linear. Channels that have higher settings on the preset already in use than on the preset to be piled-on will not change during a pile-on fade. Channels having a higher setting on the preset to be piled on will fade in during the earlier part of the fade. Such would be the case with dimmer 5 in Table I above. If scene 1 were at full, the output would be at 8. This would increase to 10 as the scene 2 fader was raised from zero. The fade from 8 to 10 would occur when the fader was raised from zero to 0.2. From 0.2 to full, no further change in the output would occur. Such as result is visually worse than the non-linearity of a scene master since the channel with the highest setting, hence the brightest lights, changes first. Similarly, removal of a piled on scene would produce just the opposite of fact, i.e., many dimmers will not fade down until the end of the fade out. Thus, it becomes clear that none of the presently available devices is capable of producing the combined type of operation desired and at the same time, providing smooth fading from scene to scene under all conditions. Thus, the need for such a device becomes evident.

SUMMARY OF THE INVENTION

The present invention provides a device which permits operation having all the advantages of both cross fader operation and scene master type operation in a single unit with the scene master operation showing improved characteristics over the prior art. The solution to the problem resides first of all in the development of a set of equations and logical decisions which must be followed in order to obtain the desired operation. In essence, this equation follows the conventional equation for cross faders where the sum of the two faders or master controls is less than one. When greater than one, a decision is made as to which of the presets in each channel is greater and depending on this decision, one of two other equations carried out. From this brief discussion, the complexity of the logical decisions and equations to be implemented is evident. However, this transfer function defined by these equations is obtained in the present invention without resorting to digital apparatus or massive analog systems. This is accomplished in spite of the fact that every channel requires the solution of a four variable equation with branching. The system of the present invention uses a central cross fade generator which feeds the memory elements. The memory elements are then combined in a passive network to achieve the desired output. At worst, each channel output requires, in addition, no more than a simple filter and buffer. All of this is achieved through a unique combination of duty cycle modulation, amplitude modulation and peak detecting combiners. The duty cycle modulation is used to carry the information regarding the values of the X and Y sides of a two handle split cross fader. The amplitude modulation is used to carry the information regarding the preset values. The combiner passes whichever of the signals has the highest instantaneous value thereby masking signals which overlap in the time domain and are blocked by a signal of greater instantaneous value from the other channel.

The essential system components comprise a waveform generator, a cross fade pulse generator, preset controller banks, a peak detector combiner and an optional output filter. The output from the device of the present invention is provided to conventional theatre lighting system dimmers such as thyristor dimmers. The waveform generator produces a repetitive waveform varying between two known limiting voltages. The period of the wave form can be varied over a wide range to accomodate various applications. Typically, it will operate in a frequency range between 50 and 10 Khz. The amplitude of the waveform can be arbitrarily selected since it is not directly related to the final output voltage of the system. In operation, the amplitude need not be regulated as long as its positive and negative peaks are continously known. In general terms, the waveform generated is compared in two comparators with a value set into the comparators using a variable voltage device such as a potentiometer representing the master control position. This provides two pulse trains having independently variable duty cycles with the pulse "on" times proportional to the setting of their associated master control. The pulses are timed such that when the sum of X and Y duty cycles is less than or equal to 100% the pulses do not overlap in the time domain. The two pulse trains referred to as the X and Y pulses are then provided to the preset memory devices, typically potentiometers where their amplitude is modulated. The pulses are then combined through a diode network. Through this arrangement of the pulse generator and preset controller all of the information necessary to solve the necessary equations is present. Because the X and Y pulses do not overlap until the sum of the duty cycles is more than 100%, the first condition about which a decision must be made is clearly distinguished. Thus; the system acts when this sum is less than or equal to 100% as a conventional cross fader. Overlap, however results in one of the two other additional equations being solved automatically depending on which the preset values is higher.

Various examples of the operation are given showing the manner in which smooth fading and cross fading is accomplished.

DETAILED DESCRIPTION OF THE PREFERRED EMBODIMENT

Figure 1:
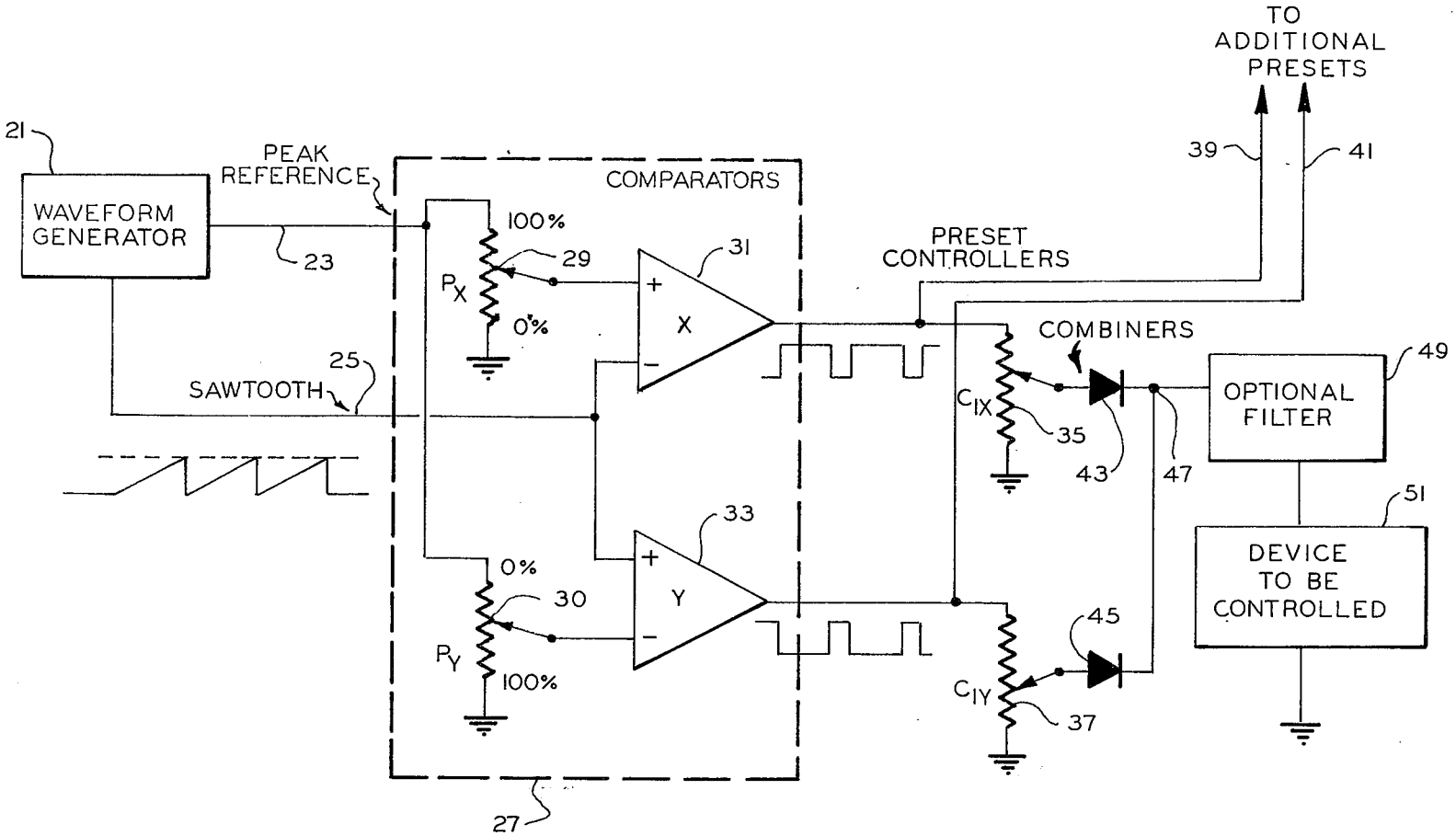
FIG. 1 is a block-circuit diagram illustrating the basic arrangement of the present invention.
Figure 1A:
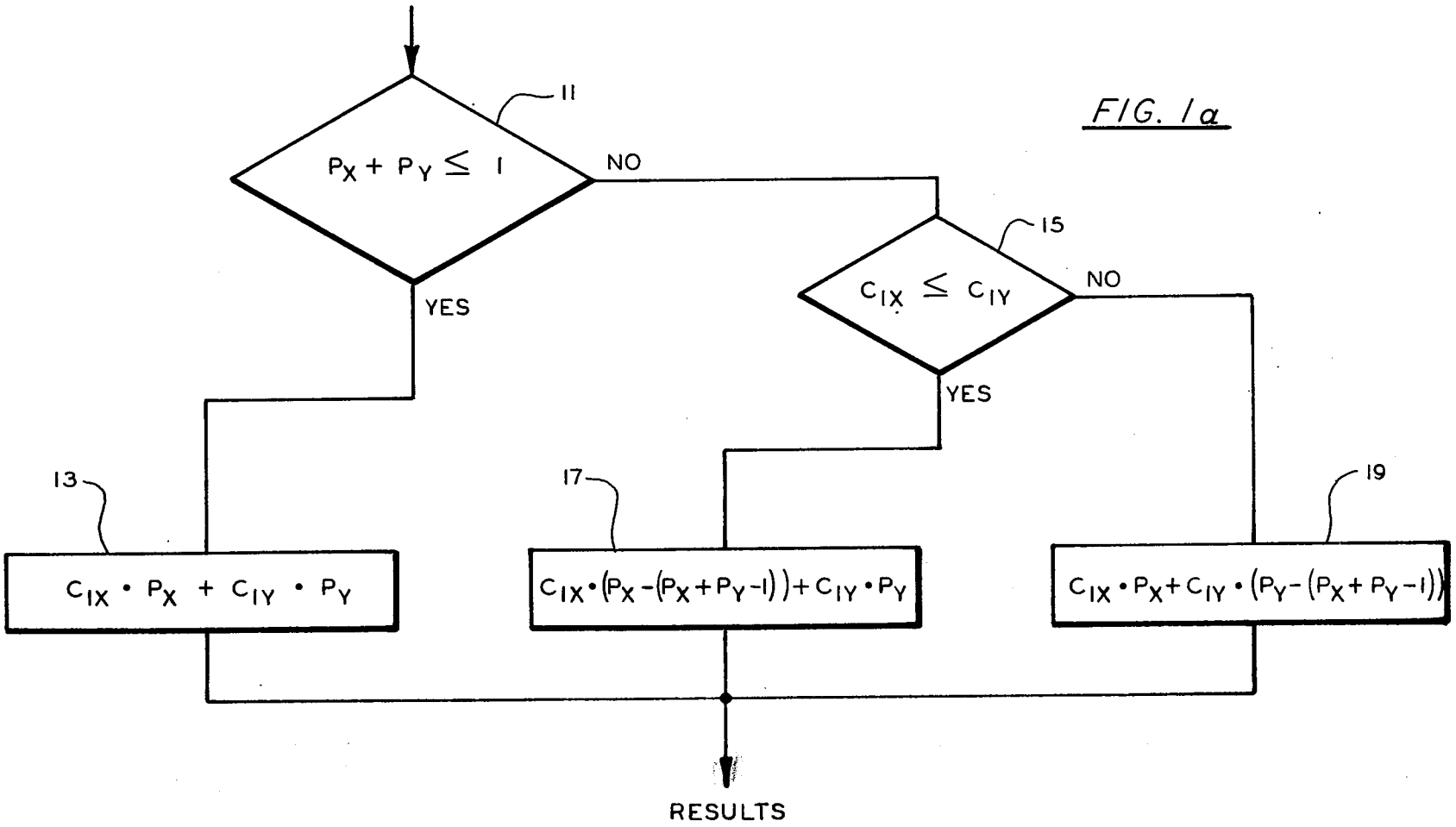
FIG. 1*a* is a flow diagram showing the equation solved by the circuit of FIG. 1.

FIG. 1 illustrates in basic block diagram form, a circuit which solves the equations set out in flow diagram form on FIG. 1*a*. The basis of the present invention lies in the recognition that the solution to equation shown in FIG. 1*a* will result in a split cross fader apparatus giving the advantages of both scene master control and cross fader control. Furthermore, the invention lies in the extremely simple implementation of this equation illustrated by FIG. 1. With reference to FIG. 1. With reference to FIG. 1*a*, it will be noted that a block 11 is entered in which a decision is made as to whether or not the sum of $P_X$ and $P_Y$ is less than one. If the answer is yes, a block 13 is entered wherein the basic cross fader equation is carried out, i.e., the output is equal to $C_{1X} \times P_X + C_{1Y} \times P_Y$. If the answer is no, i.e., if $P_X + P_Y$ is greater than one, a further decision block 15 is entered where a decision is made as to whether $C_{1X}$, a preset value on the Y side of channel 1. If $C_{1X}$ is less than or equal to 1, the answer is yes and the and the equationg of block 17 is solved. If the answer is no, then the equation of block 19 is solved. In each case, the larger of the two preset values is multiplied by its corresponding fader value and the smaller of the two values multiplied by its fader value minus the sum of the two fader values minus one. By subtracting this quantity the total is maintained below the maximum permissible values. That is, for the example given above in Table I where the one preset pot for example the value $C_{1X}$ is equal to 5 and the scene 2 pot or $C_{1Y}$ is at 6, with both faders or master controls set at 1. In that case, the quantity $C_{1X}$ would be multiplied by one to obtain 6. The quantity $C_{1X}$ would be multiplied by zero since $P_X$ plus $P_Y$ minus 1 is equal to 1 and $P_X$ equal to 1. The final output would be 6, the desired output. Were the reverse true, then equation 19 would be used. Note that in each case, the larger of the two values present at any given time is multiplied directly by its fader output so that in a case like that mentioned above where the other term becomes zero, the proper maximum output is still provided.

The arrangement of FIG. 1 will now be described along with some alternate embodiments after which a description of the manner in which the circuit obtains the solution of the equations of FIG. 1A will be given.

The system shown on FIG. 1 starts out with a waveform generator 21. As illustrated, the waveform generator can be a sawtooth generator. In any case, it produces a repetitive waveform which varies between two known limiting voltages. A period of the waveform or its frequency is variable over a wide range to accommodate various applications. Operation in the range of 50 to 10 Khz is contemplated. In operation, the frequency or period may vary several percent without affecting operation of the unit. Similarly, the amplitude of the waveform may vary and be arbitrarily selected since it is not directly related to the final output of the system.

That is, as will be seen below, this portion of the system deals in ratios and the absolute value is not particularly significant. Because of this, the amplitude may vary during operation so long as its positive and negative peaks are continuously known. In the embodiment of FIG. 1, the negative peak is held to within a few millivolts of ground. The manner in which this is accomplished will be described in more detail in connection with FIG. 7 as will other circuit details. Also, the positive peak is tracked by a DC reference voltage output on line 23. Hereafter, this will be referred to as the peak reference voltage. The shape of the waveform is one of the determinants of the transfer function of the split cross fader. If the cross fader is to be a linear transfer function then the waveform should be a linear ramp, i.e., a sawtooth or a triangular wave. It is also possible to use a sinusoidal, logarithmic or other type of input if another type of transfer function is desired. However, for the present discussion, it will be assumed that a linear transfer function is desired and the examples will be based on a sawtooth wave which is the simplest to implement. The peak reference output on line 23 and the sawtooth output on line 25 are provided as inputs to a cross fade pulse generator 27. The purpose of the cross fade pulse generator is to produce two pulse trains which have independently variable duty cycles. Hereinafter, these will be referred to as the X and Y pulses or pulse trains. The control of the duty cycle of either pulse is by way of an external variable programming voltage. This is a programming voltage proportional to a master control or fader setting. The duty cycles are variable from zero percent to 100% with both pulses having the same repetition rate. Timing of the pulses is such that when the sum of the X and Y duty cycles is less than or equal to 100% the pulses do not overlap in the time domain. A manner in which this may be simply implemented is illustrated on FIG. 1. A peak reference voltage on line 23 is provided as a reference input to two potentiometers 29 and 30. These potentiometers will be coupled to appropriate handles and provide the X and Y fader controls. Thus, potentiometer 29 has the value $P_X$ indicated next to it and the potentiometer 30 the value $P_Y$. These analog voltages proportional to the respective fader settings are converted into variable duty cycle pulse trains where the duty cycle is proportional to the analog voltage setting through the use of comparators 31 and 33. The comparators are wired so that the inverting input of the X comparator and the non-inverting input of the Y comprator are connected to the output of the waveform generator 21. The other two inputs are coupled to their respective variable voltage supplies in the form of potentiometers 29 and 30. The range of the potentiometers or other variable supplies is from the negative peak voltage to the positive peak voltage of the sawtooth waveform. As will become evident below, the amplitude of the two output waveforms must be the same. Generally, some means of assuring this will be included and typical means for carrying this out will be described below in connection with FIGS. 4 and 7.

Figure 2:
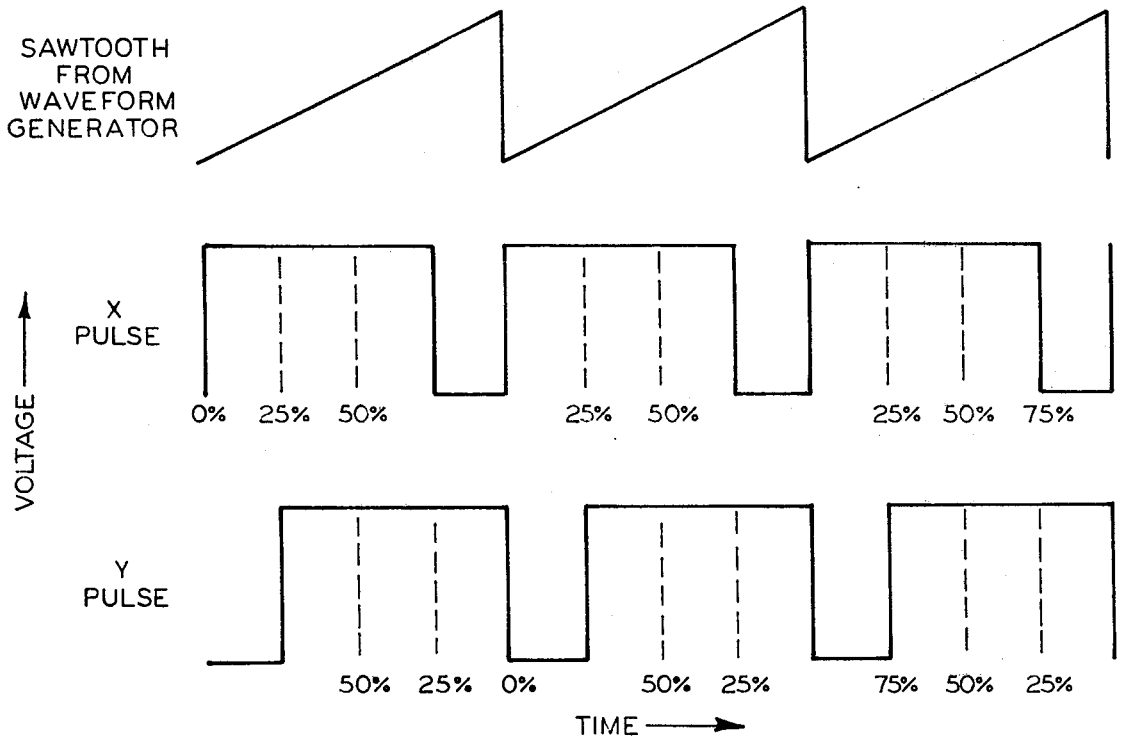
FIGS. 2 and 2*a* are waveform diagram helpful in understanding the manner in which the X and Y pulse trains FIG. 1 are generated.

The operation of the pulse generator may best be seen with reference to FIG. 2 which is a waveform diagram illustrating the sawtooth waveform along with the X and Y pulse trains. In this illustrated example, both the potentiometer 29 and the potentiometer 30 are set at 0.75 or 75%. As long as the sawtooth input to the inverting terminal of the comparator 31 does not exceed the 75% value, the output from comparator 31 shown as the X pulse will be high. At the point where the sawtooth voltage exceeds the 75% level, the voltage will switch over and go low. Thus, a pulse which is on for 75% of the duty cycle is formed. In comparator 33, the pulse will remain low until 25% of the peak reference value is reached by the sawtooth at which point it will turn on and remain high until the sawtooth is reset. Note that the potentiometer 30 when set at a 100% fader setting will have its wiper at ground or a zero voltage level and that for a 75% fader setting the voltage level will be 25%. Thus, when the sawtooth reaches 25% of the peak reference value the comparator 33 switches from low to high. Note that the end of the Y pulse is always at the beginning of the X pulse. What this means is that where the settings change, for example, to 50%, the X pulse would switch off at the 50% line shown in dotted lines and the Y pulse on at the same time. This timing is what permits detecting the condition noted in the decision block 11 of FIG. 1*a* as will be explained in more detail below.

Figure 2A:
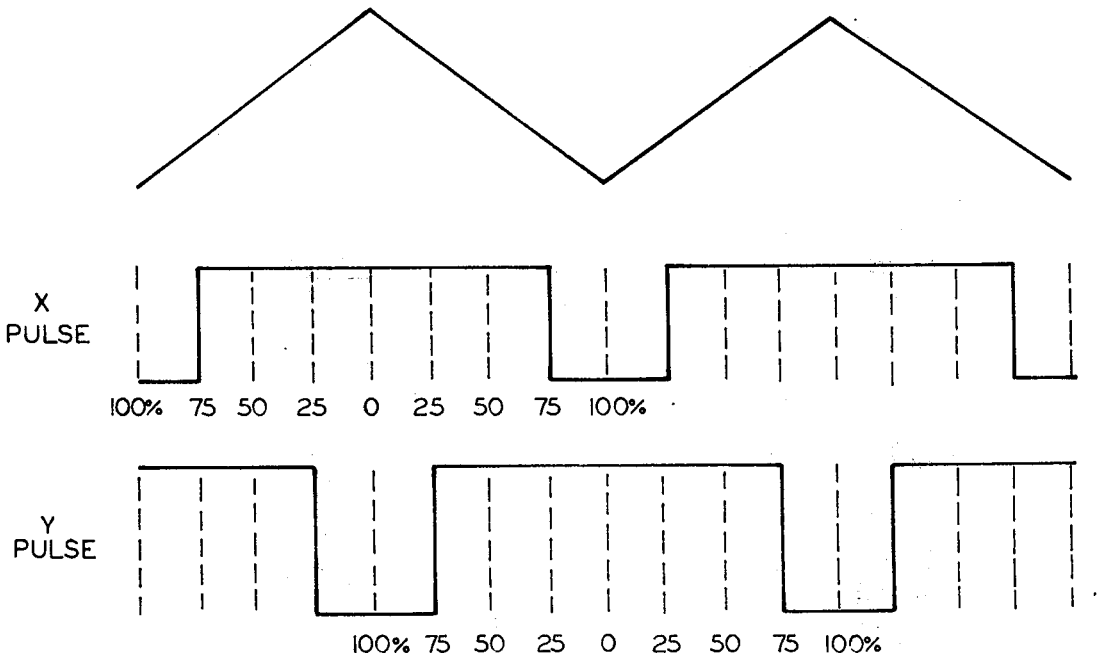

FIG. 2*a* illustrate pulse generator operation where a triangle wave form is used. Again 75% fader settings are illustrated. The X pulse is symetrical about the upper peak and the Y pulse about the lower peak. As with the saw-tooth, at less than 50% duty cycle on both pulses no overlap will exist.

As noted above, the pulses must be of the same amplitude. The reason for this is evident since the pulses are now provided to the preset potentiometers 35 and 37. As indicated by the lines 39 and 41, they may also be provided to additional preset potentiometers. Potentiometers are used herein only as an example. Any type of analog memory which will respond to the pulse trains and provide an output at a stored analog level for the length of such pulses may be used. In each of the potentiometers, the voltage pulse when present in the high condition, are multiplied by whatever value the preset potentiometer is set to. As a result, the final output from the potentiometer wipers will be a waveform whose amplitude is a function of the preset values and whose duty cycle is a function of the fader control. The average DC voltage of the pulse leaving the preset controllers is equal to the D.C. peak voltage multiplied by the duty cycle expressed by the decimal, multiplied by the setting controller expressed as a decimal. For example, if the peak voltage is ten volts and the duty cycle is 50%, i.e., 5 and the pot is set at 0.8 of the way up, the output will be ten volts times 0.5 times 0.8 or 4 volts. The output of the preset controllers, i.e., the potentiometers 35 and 37 are combined to form one output per channel. A combiner is designed to combine the signal so that the output is equal to the input that has the highest instantaneous value. In the embodiment of FIG. 1, a combiner comprises a network of diodes. Two diodes 43 and 45 are provided having their respective anodes connected to the wipers of potentiometers 35 and 37 with cathodes of all diodes from a channel connected together at a combining point such as point 47. The combined output is then provided through an optional filter 49 to the device 51 which is to be controlled. As noted above, the device 51 may be a conventional dimmer commercially available. The filter is required where the device 51 is adapted to accept only a DC level. In practice, many dimmer devices are capable of accepting a rectified AC voltage and contain therein appropriate filters. In such a case, the output from 47 may be coupled directly to such a device.

Figure 3:
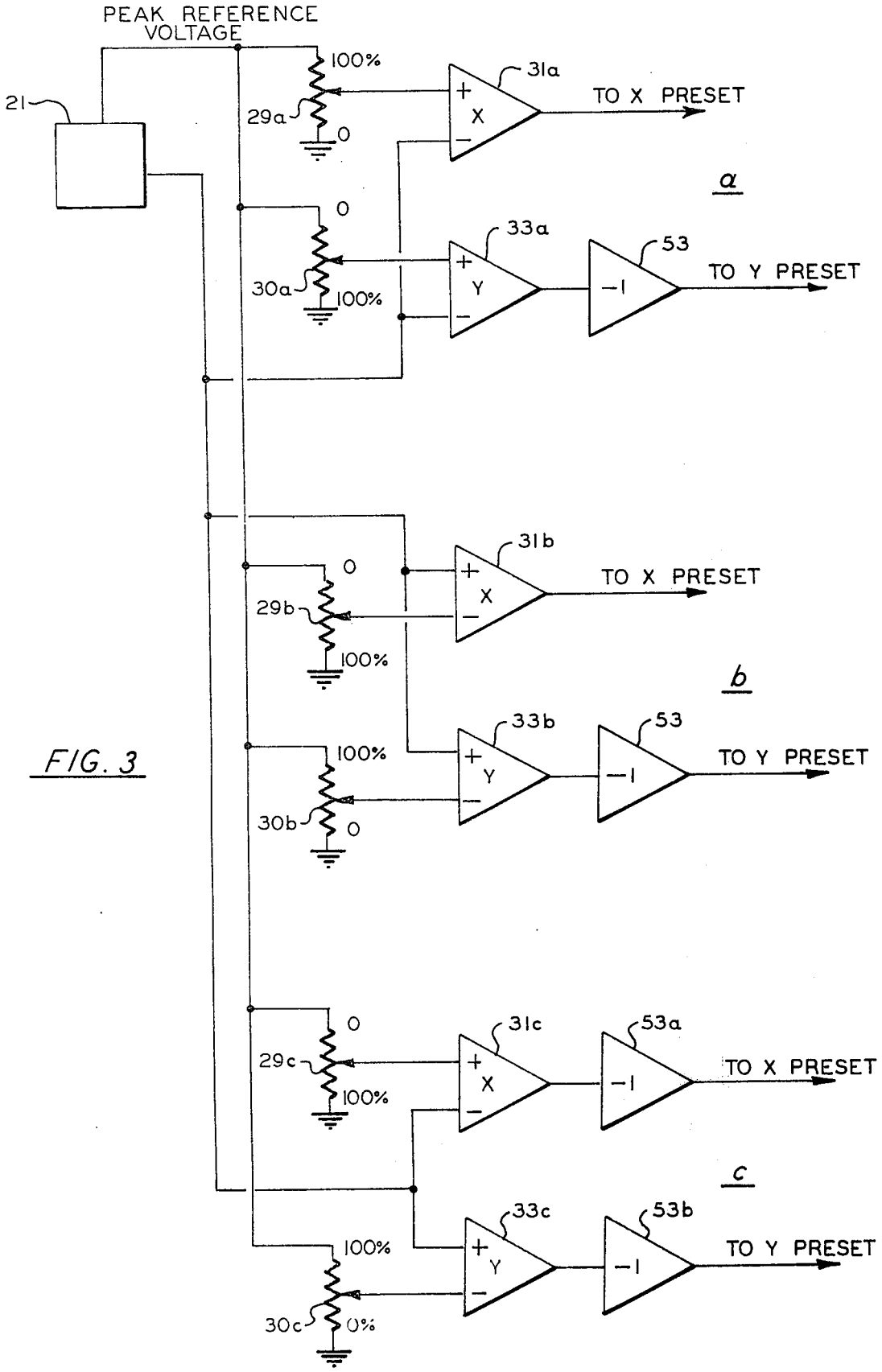
FIG. 3 is a block-schematic diagram illustrating alternate comparator arrangements.

FIG. 3 illustrates some alternate arrangements for the comparators 31 and 33. The arrangements are designated *a*, *b* and *c* with the potentiometers 29 and 30 and comparators 31 and 33 given a designation corresponding to the individual arrangements. In the arrangement *a*, the comparator 31*a* is connected exactly as was comparator 31. Comparator 33*a* however, is connected with the potentiometer input into its non-inverting input rather than its inverting input. Because of this, an additional inverting amplifier 53 is provided to invert the output of comparator 33*a* to end up with the same signal as was previously obtained. In the arrangement B, the saw-tooth voltage is provided to the noninverting terminals of both comparator 31*b* and 33*b*. Again, the output of the comparator 33*b* is inverted in an inverter 53. Note here that the two pulse trains shown on FIG. 2 will be reversed. That is to say that the X pulse will now look like the Y pulse and the Y pulse like the X pulse. This points out that the absolute phase of these two pulse trains is not particularly significant but only that their phase with respect to each other must meet the requirements noted above. With the arrangement a or b, the inverting amplifier could just as well be associated with the comparator 31*a*.

In the arrangement of c of FIG. 3, the two comparators are wired exactly as in FIG. 1. However, in this case, their outputs are each inverted by an inverting amplifier 53*a* and 53*b* respectively. Again, this will result in an inversion of the two pulse trains, the pulse train Y becoming X and X becoming Y. Various other configurations are possible with the only requirement being that two pulse trains are properly phased with respect to each other, i.e., phased so that there is no overlap when the total duty cycle is less than 100%.

Figure 4:
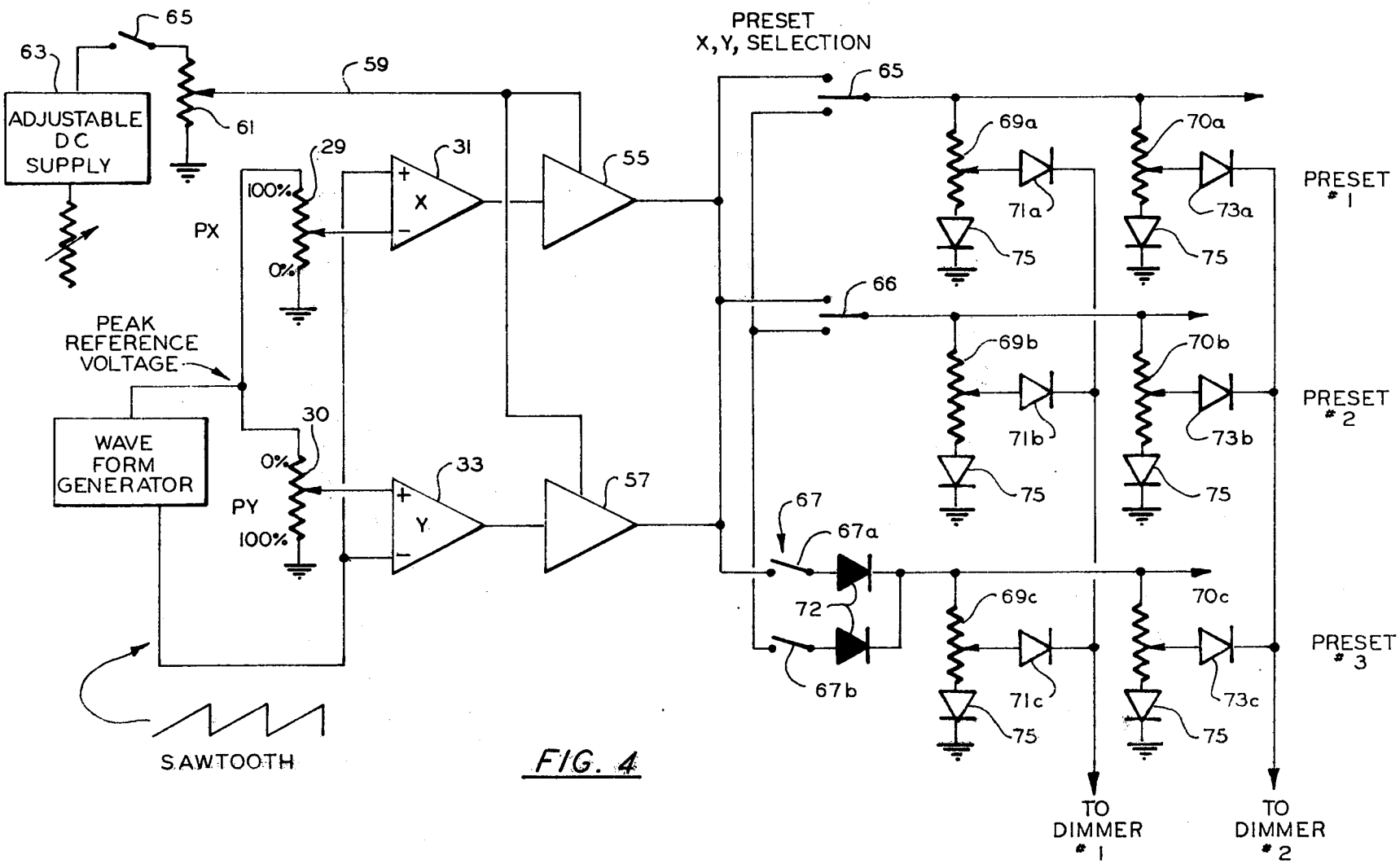
FIG. 4 is a diagram similar to FIG. 1 illustrating the control of a plurality of preset potentiometers along with illustrating additional features of the present invention.

FIG. 4 illustrates a further embodiment of the invention. The circuit through the comparators 31 and 33 is exactly as described in FIG. 1. However, the outputs of the respective comparators 31 and 33 are coupled to inverting switching amplifiers and buffers 55 and 57. In this case, the comparator outputs from comparators 31 and 33 do not need to have particularly accurate amplitudes since the final output amplitude is determined by the amplifiers 55 and 57. The input voltage to these switching amplifiers which will determine their output voltage is obtained from a line 59 coupled to the wiper of a potentiometer 61. This illustrates another feature which may be included in this system. The line 59 could just as easily be provided to a fixed or an adjustable DC supply directly. However, in this case, it is provided through potentiometer 61 designated as a grand master control. Control of this potentiometer permits dimming all lights being operated at the time by affecting all control voltages. In addition, the input to the potentiometer is coupled to the DC voltage supply 63 through what is referred to as a blackout switch 65. Opening this switch will result in blacking out all lights. The supply 63 is simply an adjustable DC supply of conventional design. Making the supply adjustable rather than fixed permits, first of all, trimming the supply and, second of all, provides the present system with greater flexibility in that its voltage can be adjusted to match various different types of dimmers. For example, some of these controls have a maximum voltage input of 5 volts whereas others may have a maximum of 38 volts. Thus providing an adjustable supply, device of the present invention may be used with any type of dimmer control. The outputs from the amplifiers 55 and 57 which will be the pulse trains of FIG. 2 are provided to a plurality of switches 65 to 67.

Each output is provided to one pole of the switches 65 and 66 which are single-pole, double-throw switches. The X output is also provided switch 67*a* and the Y output to switch 67*b*. This is an alternate form of switch to be described in greater detail below. The common terminals of the switches 65 and 66 are coupled to present potentiometers 69*a* and *b* and 70*a* and *b*. Switches 67*a* and 67*b* have their other terminals coupled through isolation diodes 72 to the present potentiometers 69*c* and 70*c*. Each set of potentiometers 69*a* and 70*a*, 69*b* and 70*b* and 69*c* and 70*c* represents a separate preset or separate scene. The outputs of the potentiometers 69*a*, *b* and *c* are coupled through diodes 71*a*, *b* and *c* to a first dimmer and wipers of potentiometers 70*a*, *b* and *c* through respective diodes 73*a*, 73*b* and 73*c* to a second dimmer. Each of the potentiometers is coupled to ground through a diode 75 used to compensate for the diode drop through the diodes 71 and 73. The arrangement of the diodes 71*a* through *c* and 73*a* through *c* is the same as the diodes 43 and 45 of FIG. 1. In operation, normally two of the switches 65, 66 and 67 will be operated. That is switch 65 may be set to the master control X for example, by moving it upward and the switch 66 to the master control Y by moving it downward. Presuming that scene X is the first scene, the potentiometer 29 will start out on full and the potentiometer 30 at zero. When it is desired to move in to the next sence, i.e., the scene identified to the right hand side as preset 2, the two potentiometers 29 and 30 can be moved to carry out cross fading in the manner described above. At the end of this time, the potentiometer 29 will be at zero and the potentiometer 30 at full. The proper levels for preset 2 will now be present. At that point, the switch 65 may be moved to the position shown and the switch 67*a* moved downward to couple the preset 3 potentiometers to the master control X. This then permits fading out the preset 2 scene and fading in the preset 3 scene by moving the potentiometers 29 and 30 in the opposite direction.

With the arrangement of switch 67 (switches 65 and 66 may also be in this form) both switches 67*a* and 67*b* can be closed to couple both the X and Y master controls to the presets. This gives the system further flexibility.

Figure 5:
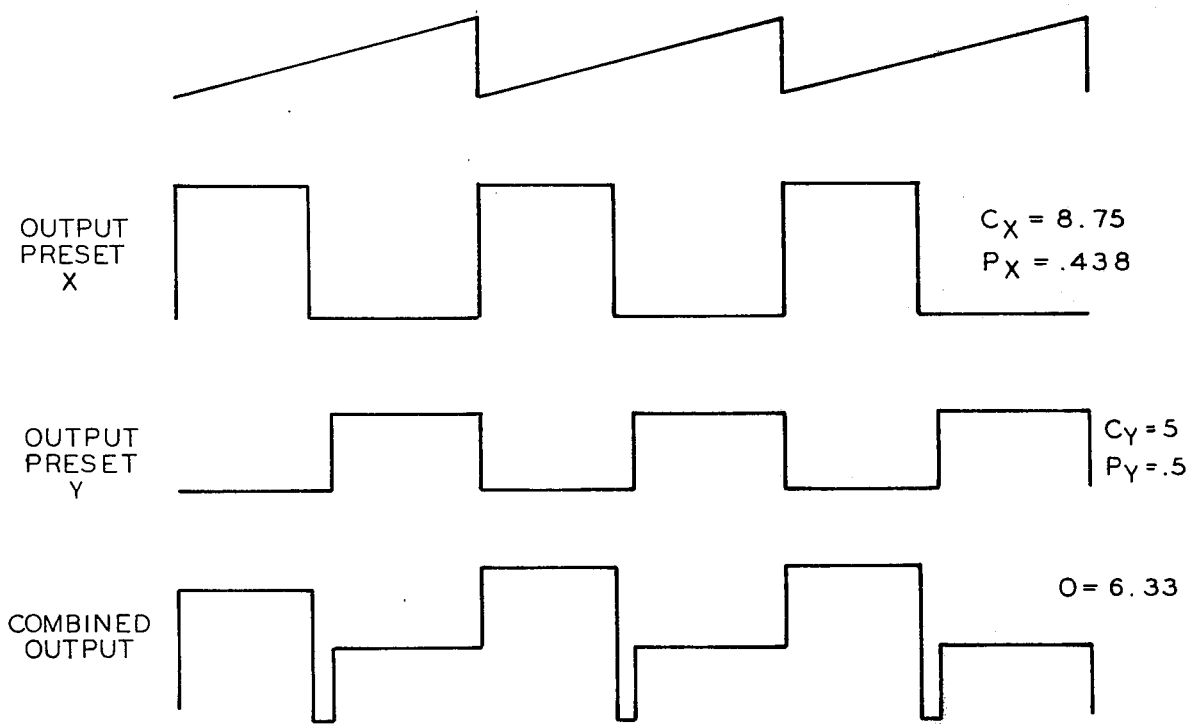
FIG. 5 and 6 are waveform diagrams illustrating the operation of the circuits of FIGS. 1 and 4.
Figure 6:
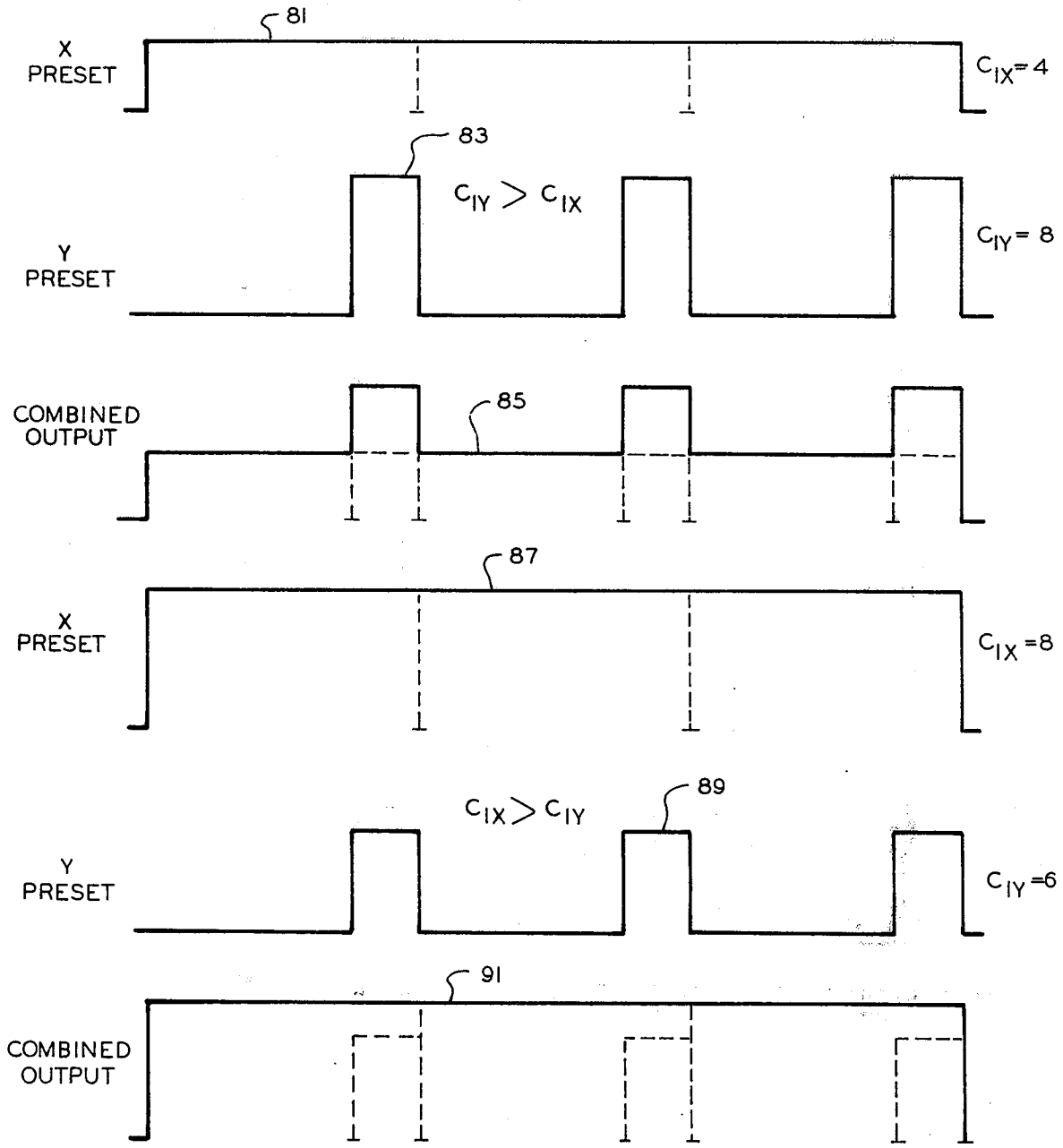

FIGS. 5 and 6 are helpful in understanding the manner in which the equations of FIG. 1*a* are solved by the circuits described above in connection with FIGS. 1, 3 and 4. FIG. 5 illustrates a condition for FIG. 1 where the potentiometer 29, $P_X$ is set to 0.438 and the potentiometer 30, $P_Y$ to 0.5. $C_{1Y}$ is set to 0.5 and $C_{1X\ to}$ 8.75. The result from the outputs of potentiometers 35 and 37 will be as indicated by the waveforms labelled "output preset X" and "output preset Y". That is to say, the X waveform will have pulses of a relative height of 8.75 in accordance with the setting of potentiometer 35 and will have a duty cycle of slightly less than 50%, i.e., 43.8%. The Y output will have a relative amplitude of 0.5 and a duty cycle of exactly 50%. When combined through the diodes 43 and 45, the output at point 47 will appear as indicated by the waveform labelled "combined output". The average value of this waveform, as indicated, is 6.33. If the equation of block 13 of FIG. 1*a* is solved, this is the result obtained. Thus, when operating under the condition where $P_X + P_Y$ is equal to or less than one, the system operates in the desired manner.

FIG. 6 illustrates a case where the potentiometer 29, $P_X$, is set to 100%. In that case, a fullduty cycle as indicated by the wave 81 results. In this example, $C_{1X}$ is set equal to 4 so that the the amplitude of the wave form 81 will have a relative value of 4. The Y preset is set for a 25% duty cycle through the setting of potentiometer 30, $P_Y$, and its amplitude set at potentiometer 37 to a relative value of 8. Thus, it appears a the waveform 83 of FIG. 6. This is the condition of FIG. 1*a* of decision block 15 where $C_{1Y}$ is greater than $C_{1X}$. Thus, the equation of block 17 should be solved. The combined output of the waveforms 81 and 83 is shown as waveform 85. This is the output which will appear at point 47. Note that with this waveform, the combined output stays at the X level of 4 for 75% of the time but rises to the Y level of 8 for the remaining 25% of the time. The average DC value of the output will be equal to $0.75 \times 4 + .2.5 \times 8$ or it will be equal to 5. Solving equation 17, one would obtain the following:

$$4\ (1 - (1 + 0.25 - 1)) + 8\ (0.25) = 4\ (0.75) + 8\ (0.25)$$

Or in other words, one obtains exactly the correct solution to the equation. Prior to the Y preset being moved, i.e., with it at 0, and with the X preset on full, the final output would have been 4. If the case being considered is where the Y fader is going to be moved all the way in to obtain a pile condition then what is desired is a smooth fade from 4 to 8. It can be seen that over the first quarter of the travel a change of 1 has occured. As the Y fader is increased the output will increase in a linear manner so that when the Y fader reaches full the output will be equal to the value 8 set in the Y preset controller. What is occuring here to obtain this solution is that, when the sum of the duty cycle exceeds 100%, i.e., when $P_X + P_Y$ is greater than one, the pulses start to overlap. Since the combiner passes only the signal with the highest instantaneous amplitude, the pulse which has the lower amplitude will be masked during the overlap. This will have the effect of shortening the duration of the lower amplitude pulse by a term equal to the excess of the sum of the duty cycles over 100%, i.e., $P_X + P_Y - 1$. When the two pulses are of the same amplitude, the output will appear to be a steady DC voltage and it is not possible to determine which side masks the other. But the effect numerically on the output will be the same as if this term were subtracted from the preset pulse duration of either side. The portion that is subtracted out is shown in dotted lines cross-hatched on FIG. 5. In this way, the combiner solves the second and third equations 17 and 19 of the equation of FIG. 1*a* by steering the excess term for the proper side of the equation.

The remaining waveforms on FIG. 6 illustrate the case where $C_{1X}$ is greater than $C_{1Y}$. Once again, the X fader is set for a 100% or full duty cycle. Now, however, it has a relative amplitude of 8, i.e., its preset potentiometer 35 is set to 80%. $C_{1Y}$ however, is only set to 6 by its potentiometer 37. The X output from its potentiometer 35 is shown as waveform 87 and the Y output from potentiometer 37 as waveform 89. The combined output is represented by waveform 91. In this case, since when carrying out a pile-on fade, the final value will be the X value which is already present, the Y value is completely masked and has no effect.

Clearly, regardless of the setting of the controls, the output will be limited to a value equal to the highest of either $C_{1X}$ or $C_{1Y}$. The examples given above clearly illustrate what occurs during a pile-on or a cross-fade. A few additional examples will be given of cases which are not strictly pile-on or cross fade. In describing the behavior of the system, the terms fade in and fade out are used and are essentially the same with only the steps reversed. In the example to be given, the Y fader is at 0.5 and the X fader starts at zero. Consider first the example where $C_{1Y}$ is less than $C_{1X}$. As the cross fader is increased, the output will increase by a slope defined by the points 0.5 $C_{1Y}$ and 0.5 $C_{1Y}$ + 0.5 $C_{1X}$. The last point is reached when the X fader reaches 0.5. At that point, the slope decreases so that for the rest of the X fader travel it is defined by the points 0.5 $C_{1Y}$ + 0.5 $C_{1X}$ and $C_{1X}$. Where $C_{1Y}$ is greater than $C_{1X}$, the output increases by a slope defined by the points 0.5 $C_{1Y}$ and 0.5 $C_{1Y}$ + 0.5 $C_{1X}$. At the point where the line reaches 0.5 $C_{1Y}$ + 0.5 $C_{1X}$ the slope flattens to zero. In other words, the output no longer increases during the rest of the X fader travel. Even in these cases, a fairly smooth transition takes place without jumps and performance much superior to that presently available is provided.

Figure 7:
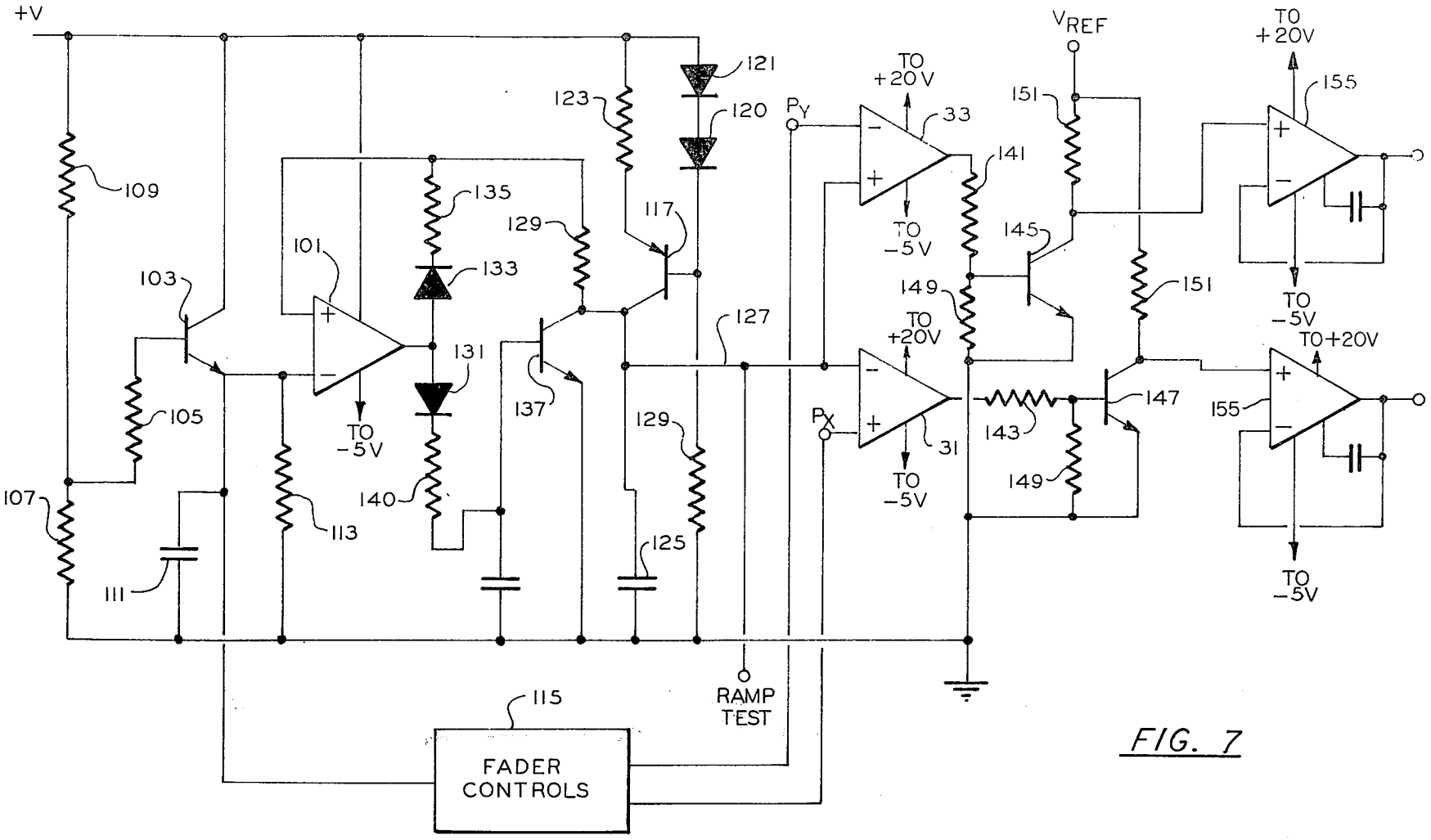
FIG. 7 is a circuit diagram of a preferred embodiment of a wave form gnerator and comparator arrangement for developing the X and Y pulse trains.

FIG. 7 illustrates a detailed circuit diagram of an embodiment of the waveform generator 21 and pulse generator 27 of FIG. 1. This embodiment incorporates the switching amplifiers and buffers referred to in connection with FIG. 4. The ramp generator is built around a comparator 101. The comparator is supplied with positive and negative supply voltages in conventional fashion. At its inverting input, it obtains an output from an emitter follower transistor 103 having its base coupled through a resistor 105 to the mid point of a voltage divider made up of resistors 107 and 109 connected between the positive voltage supply and ground. The emitter is coupled to ground through a decoupling capacitor 111 and through a resistor 113. The effect of this arrangement is to present a constant voltage determined by the voltage divider to the inverting input of the comparator 101. This voltage present at the emitter of transistor 103 is the peak reference voltage referred to in connection with FIG. 1 and is provided to the fader control block 115 which will contain appropriate handles coupled to potentiometers such as potentiometers 29 and 30 of FIG. 1 which provide the outputs $P_X$ and $P_Y$. In the waveform generator, a constant current source is provided. This constant current source comprises transistor 117 which has its base biased by a voltage divider made up of a resistor 119 and two diodes 120 and 121 in series between the positive voltage and ground. The emitter of transistor 117 is coupled to the positive voltage through a resistor 123. The collector of transistor 117 supplies a constant current to a capacitor 125 which integrates that current to provide the saw-tooth voltage output on line 127. The saw-tooth voltage is also fed back through resistor 129 to the non-inverting input of the comparator 101. At the beginning of the ramp, the voltage on line 127 is below the reference voltage at the inverting input to the comparator 101 and the comparator output remains at the negative supply level. Diodes 131 and 133 coupled to the output of the comparator are thus back biased. Once the ramp reaches the reference level, however, the comparator switches, its output becoming positive. This positive voltage is supplied through the diode 133, a resistor 135 and resistor 129 to the collector of transistor 137. Transistor 137 also has its base coupled through a resistor 139 and restor 140 and diode 131 to the output of the comparator. The positive voltage thereon turns on the transistor 137 causing its collector to be essentially at ground level. This causes the capacitor 125 to discharge resetting the waveform generator ramp voltage. The ratio of the resistors 135 and 129 is made the same as the ratio of the resistors 109 and 107. As a result, the comparator 101 will not switch back to the negative state until the voltage on line 127 reaches ground level. At that point, the output of the comparator 101 which is close supply voltage level will then be present on one side of the voltage divider with ground on the other side resulting in essentially the same voltage at the non-inverting input as the inverting input because the diode drop of diode 133 and the VBE drop transistor 103 are similar. Thus, the comparator will switch back to its other state.

The saw-tooth voltage on line 127 is provided to the comparators 31 and 33 in a manner described above. The outputs from the comparators are provided through respective resistors 141 and 143 to the bases of switching transistors 145 and 147. The bases of each of these transistors is also coupled through a further resistor 149 to ground. They have their collectors coupled through a resistor 151 to an accurate reference voltage. The voltage applied to the collectors of these transistors is the voltage which must be accurate. The voltage output of the comparators themselves is immaterial since it is used only for switching purposes. Transistors 145 and 147 since they both have the same reference input voltage, will provide outputs at the same amplitude thus fulfilling the requirement noted above. These outputs are then coupled through additional driver and buffer amplifiers 155 to the preset potentiometers such as the potentiometers 35 and 37 of FIG. 1 or the potentiometers 69 and 70 of FIG. 4 to avoid loading resistors 151. Where a large number of potentiometers are being driven, additional power amplifiers may be included between amplifiers 155 and the potentiometers.

The described circuit can be built to operate with the linearity of approximately 3% without special trimming. It is temperature stable and does not require close power supply regulation. It is in fact relatively free of the type of problems which make most analog systems, such as those prior art systems using precision, summing and multiplication units, subject to drift and error. In the present circuit, accuracy within a range of less than 1% can easily be achieved.

Figure 8:
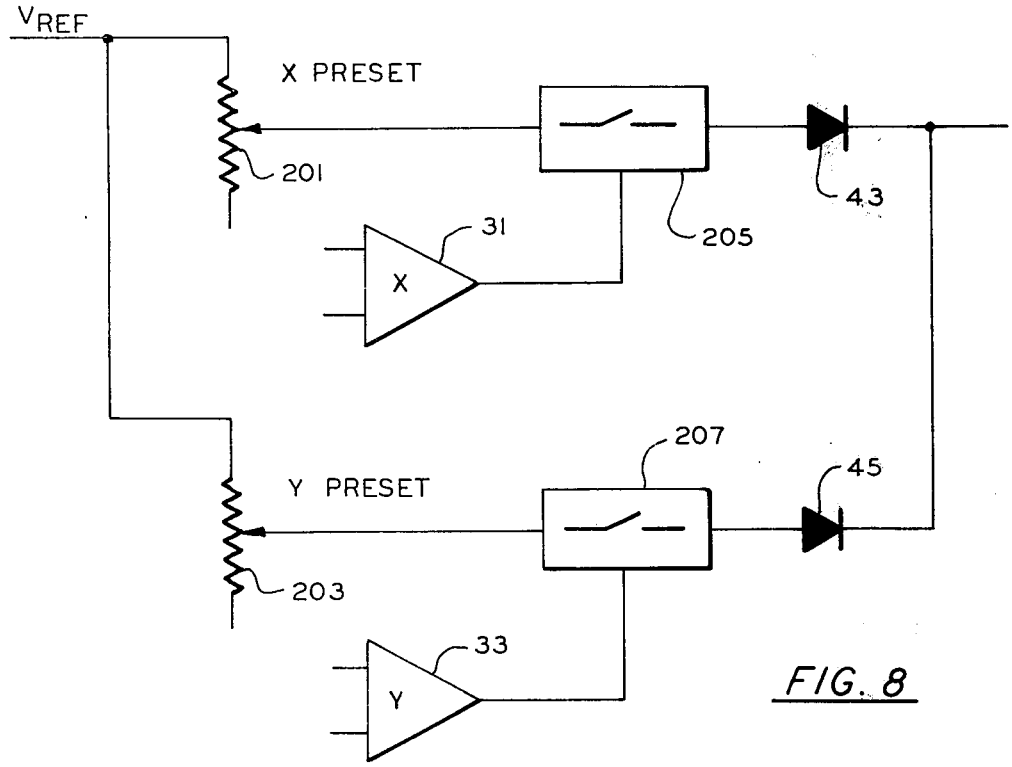
FIG. 8 is a block diagram of alternate embodiment of the present invention.

FIG. 8 illustrates an alternate to the arrangement of FIG. 1. The pulse generator of which only comparators 31 and 33 are shown is as in FIG. 1. However rather than modulating the pulses using potentiometers such as 35 and 37 of FIG. 1, the pulse outputs are used to modulate preset voltages obtained from preset potentiometers 201 and 203. The end result is the same. The DC voltage outputs of potentiometers 201 and 203 are fed to switches 205 and 207. Shown schematically as switches these will preferably be electronic switches such as transistors or FETS having their control terminal coupled to the outputs of comparators 31 and 33. At low frequencies these switches may even be relays with their coils coupled to the comparator outputs. The switch outputs with a magnitude proportional to the preset and a duration proportional to fader setting are then combined through diodes 43 and 45 in the manner described above.

Thus, an improved split fader for use in theatre lighting and the like has been shown. Although specific embodiments have been illustrated and described, it will be obvious to those skilled in the art that various modifications may be made without departing from the spirit of the invention which is intended to be limited solely by the appended claims.

What is claimed is:

1. A method of developing voltage control signals to be provided to a control unit which is to be controlled in response to either of two control inputs with fading between inputs possible, comprising:

a. developing a first pulse train with pulses thereon having a duty cycle of between zero and one hundred percent which is directly proportional to a desired value of $P_X$ corresponding to a first fader control position which may also vary between 0 and 100 percent;

b. developing a second pulse train having a duty cycle varying between zero and one hundred percent, the duty cycle being directly proportional to the desired value of $P_Y$ corresponding to a second fader control position which also varies between zero and one hundred percent, the timing of said first and second pulse trains being such so that when the sum of the duty cycles of the pulses on said first and second pulse trains is less than one hundred percent, the pulses do not overlap in the time domain;

c. multiplying said first pulse train by a value $C_{1X}$ corresponding to a first input preset to develop a first modulated pulse train;

d. multiplying modulating said second pulse train by a quantity $C_{1Y}$ corresponding to a second input preset to develop a second modulated pulse train;

e. combining said first and second modulated pulse trains to provide an output which has a magnitude equal to the largest magnitude of either pulse train present at a given time, said output signal being the signal provided to drive said control unit.

2. The method of claim 1 wherein said control unit is a dimmer such as dimmers used in stage lighting, said method permitting operation as a scene master control, a cross fader control and a pile-on control for two scenes and said first and second inputs are first and second scenes respectively.

3. The method of claim 1 wherein said multiplying is carried out by generating first and second pulse trains having pulses thereon of equal amplitude and multiplying said pulse trains by the values $C_{1X}$ and $C_{1Y}$, respectively.

4. The method of claim 1 wherein said multiplying of said first and second pulse trains is done by amplitude modulating said pulse trains.

5. Apparatus for developing voltage control signals to be provided to a control unit which is to be controlled in response to either of two control inputs with fading between inputs possible, comprising:

a. means for generating a periodic waveform voltage having an upper peak reference and lower peak reference value;

b. means for generating a first analog voltage proportional to a value $P_X$ corresponding to a first fader control position;

c. means for generating a second analog voltage inversely proportional to a value $P_Y$ corresponding to a second fader control position;

d. first means for comparing said periodic waveform with said first analog voltage and for providing an output at one level when said first analog voltage is greater than the voltage of said waveform and at another level when said waveform voltage is greater than said first analog voltage to thereby develop a first pulse train having a duty cycle variable between 0 and 100 percent;

e. second means for comparing said periodic voltage with said second analog voltage and for providing an output at said one level when said waveform voltage is greater than said second analog voltage and at said other level when said waveform voltage is less than said second analog voltage to provide a second pulse train, the timing of said first and second pulse trains being such so that when the sum of the duty cycles of the pulses on said first and second pulse trains is less than 100 percent, the pulses do not overlap in the time domain;

f. first storage means for storing a value $C_{1X}$ proportional to a first preset, said first storage means having said first pulse train as an input and responsive to provide pulses having the same duty cycle as said input pulse train and having an amplitude proportional to said value $C_{1X}$;

g. second storage means for storing a value $C_{1Y}$ proportional to a second output preset, said second voltage storage means having said second pulse train as an input and responsive to provide output pulses having the same duty cycle and having an amplitude proportional to said value $C_{1Y}$; and h. means for combining the outputs of said first and second storage means so as to provide an output equal to the greater instantaneous value of said two inputs, said output being the control voltage of said circuit.

6. The apparatus according to claim 5 wherein said control unit is a dimmer such as dimmers used in stage lighting, said method permitting operation as a scene master control, a cross fader control and a pile-on control for two scenes and said first and second inputs are first and second scenes respectively.

7. The apparatus according to claim 6 wherein said means for providing first and second analog voltages comprise first and second potentiometers referenced to said higher and lower peak references.

8. The apparatus according to claim 7 wherein the setting of the first potentiometer providing an output value proportional to $P_X$ is such that for a 100 percent $P_X$ value, the wiper of said potentiometer is at the end coupled to said upper peak reference and for a 100 percent $P_Y$ value, the wiper of said second potentiometer is at the end of said potentiometer coupled to the lower peak reference.

9. The apparatus according to claim 8 wherein said means for comparing comprise first and second comparators, one having its inverting input coupled to said waveform generator and the other its non-inverting input thereto, the second inputs of said comparators being coupled respectively to the wipers of said first and second potentiometers.

10. The apparatus according to claim 9 wherein said first and second storage means comprise first and second potentiometers coupled between the output of said comparing means and ground, said potentiometers having their wipers preset to correspond to said values $C_{1X}$ and $C_{1Y}$, respectively whereby the voltage output of said comparators will be multiplied by the fractional setting of said potentiometers.

11. The apparatus according to claim 10 wherein said means for combining comprises a diode network.

12. The apparatus according to claim 11 wherein said diode network comprises first and second diodes having their anodes coupled respectively to the wipers of said first and second potentiometers and their cathodes coupled together to provide the final circuit output.

13. The apparatus according to claim 11 and further including a filter coupled between said diode network and the final circuit output.

14. The apparatus according to claim 6 and further including pairs of voltage storage means $C_{2X}$, $C_{2Y}$ . . . $C_{NX}$, $C_{NY}$, each of said additional storage means being separately preset and having their inputs coupled to the outputs of said first and second comparator means.

15. The apparatus according to claim 14 wherein each of said voltage storage means comprises a potentiometer coupled between a comparator means output and ground.

16. The apparatus according to claim 6 and further including a switching amplifier between each of said comparing means and each of said voltage storage means.

17. The apparatus according to claim 16 wherein said switching amplifier comprises a transistor switch.

18. The apparatus according to claim 17 wherein each of said transistors is supplied with a predetermined voltage level from a voltage supply.

19. The apparatus according to claim 18 wherein said supply is adjustable.

20. The apparatus according to claim 19 and further including a blackout switch in the line coupling said switching amplifiers and said voltage supply.

21. The apparatus according to claim 20 and further including a potentiometer in the line coupling said supply and said transistors.

22. The apparatus according to claim 6 wherein said voltage storage means are coupled to said comparing means outputs through switches, whereby different sets of said voltage storage means may be coupled to different ones of said comparing means outputs.

23. The apparatus according to claim 22 and further including a diode coupling said potentiometers to ground to thereby compensate for the voltage drop through the diodes in said combining means.

24. The apparatus according to claim 6 wherein said voltage storage means are coupled to said comparing means through individual switches and further including isolation diodes between each comparator and storage means whereby a single storage means can simultaneously be coupled to both of said comparing means.

* * * * *

UNITED STATES PATENT AND TRADEMARK OFFICE

CERTIFICATE OF CORRECTION

PATENT NO. : 3,946,273

DATED : March 23, 1976

INVENTOR(S) : Robert M. Goddard

It is certified that error appears in the above-identified patent and that said Letters Patent are hereby corrected as shown below:

Column 5, line 23 change "50 and 10 Khz" to -- 50 hz and 10 Khz --.

Column 6, line 21 delete "With reference to FIG. 1".

Column 6, line 31 remove "and the" (first occurrence).

Column 6, line 33 change "equationg" to -- equation --.

Column 6, line 63 change "50 to 10 Khz" to -- 50 hz to 10 Khz --.

Column 10, line 9 change "present" to -- preset --.

Column 10, line 11 change "present" to -- preset --.

Column 11, line 10 change "a" to -- as --.

Column 11, line 20 change ".2.5" to -- 2.5 --.

Column 13, line 1 change "restor" to -- resistor --.

Column 14, line 30 delete "modulating".

Signed and Sealed this

Twentieth Day of July 1976

[SEAL]

*Attest:*

RUTH C. MASON
*Attesting Officer*

C. MARSHALL DANN
*Commissioner of Patents and Trademarks*